United States Patent [19]

Borcoman

[11] 4,005,963

[45] Feb. 1, 1977

[54] PRODUCTION LINE FOR FORMING CONCRETE ELEMENTS

[76] Inventor: Mircea Borcoman, 7 rue de l'Etoile, Paris, France

[22] Filed: Oct. 18, 1974

[21] Appl. No.: 516,127

[30] Foreign Application Priority Data

Oct. 23, 1973 France ..... 73.37715

[52] U.S. Cl. ..... 425/218; 425/88; 425/404; 425/424; 425/441; 425/454

[51] Int. Cl.[2] ..... B28B 1/08; B28B 7/10

[58] Field of Search ..... 425/88, 404, 439, 441, 425/445–446, 452–455, 218, 424, DIG. 200–DIG. 201; 249/137–138

[56] References Cited

UNITED STATES PATENTS

| | | | |
|---|---|---|---|
| 813,721 | 2/1906 | Lambie | 425/455 |
| 838,278 | 12/1906 | Schwartz | 425/452 |
| 1,618,582 | 2/1927 | Dewison et al. | 425/455 |
| 2,777,184 | 1/1957 | Monk et al. | 425/453 |
| 3,255,866 | 6/1966 | Gulde et al. | 425/452 |
| 3,379,124 | 4/1968 | Bruder et al. | 425/DIG. 200 |
| 3,578,276 | 5/1971 | Soderlund | 249/137 |
| 3,612,159 | 10/1971 | Galinsky | 425/455 |

*Primary Examiner*—Richard B. Lazarus
*Assistant Examiner*—John McQuade
*Attorney, Agent, or Firm*—Larson, Taylor and Hinds

[57] ABSTRACT

An apparatus for continuously producing concrete elements of varied cross-sections which comprises a mold formed from a cover and a shell supported on a tiltable frame. The frame is capable of orienting the mold vertically to allow the elements to be cast and then rotating to the horizontal to separate the shell from the casting and the cover. The apparatus further contains a heating tunnel to harden the casting and a carriage with a pushing member for separating the covers from the finished elements. A guide rail is provided to reinsert the covers into the mold.

15 Claims, 15 Drawing Figures

FIG.4.
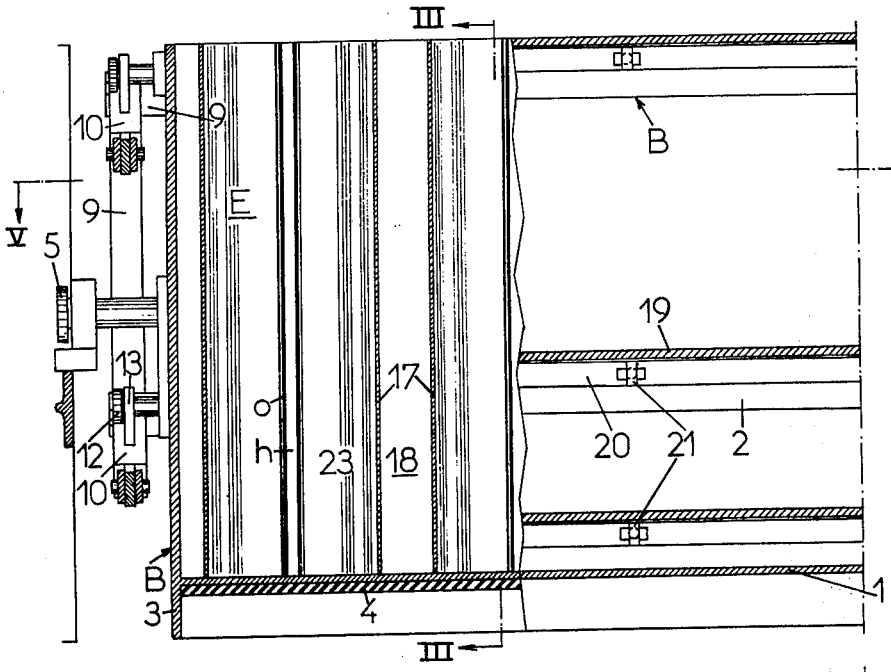
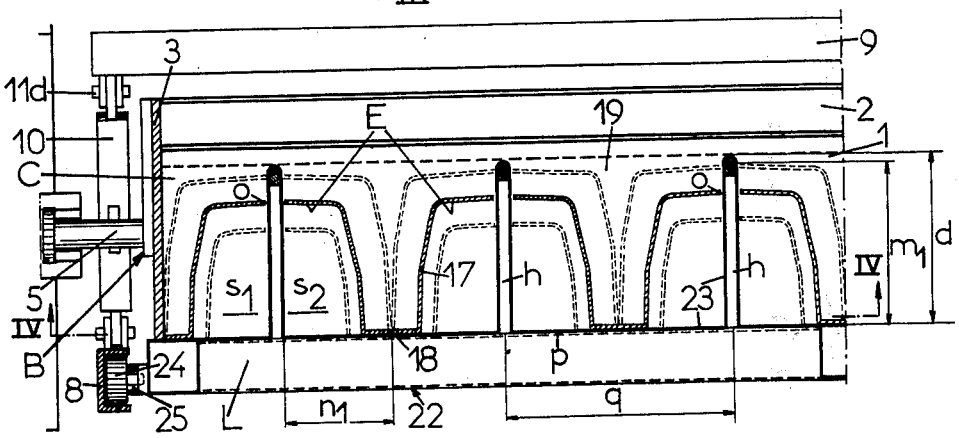
FIG.5.

PRODUCTION LINE FOR FORMING CONCRETE ELEMENTS

The invention relates to a production line for concrete elements such as curbs or gutters, capable of being produced with a decorative facing.

Hitherto, for the manufacture of linear concrete elements, such as curbs (curbs for sidewalks of roads, gutters, etc..), there have been used production lines of two types. In a first type, the casting of the concrete was done in flat molds. The compacting of the concrete was effected by external vibration with respect to the mold and the parts thus produced were then unmolded, either by dismantling the mold, or by tilting the fresh concrete parts onto a platform arranged for this purpose and on which the products harden. This first type of production line cannot ensure a good quality product either from the point of view of dimensional tolerances or appearance. The productivity of this production line is very low and the areas required are large.

A second type of production line operates with vibrocompression of the concrete in machined metallic molds, which enables the outer appearance of the product to be improved. However, the unmolding which is effected simultaneously on five sides involves a certain percentage of rejects. This percentage becomes greater and greater progressively with the aging of the molds. In addition, the cost of the molds and of the installations is high and the area necessary for the operation is large. The production costs are high as result of large energy consumption and the considerable mechanical maintenance required.

It is a particular object of the invention, to provide a production line for linear concrete elements which responds to the various exigencies of practice better than hitherto and which enables the production of products having an appearance practically without defect, with high productivity and with low production costs.

According to the invention, a production line for linear concrete elements such as curbs or gutters, capable of being produced with a decorative facing, comprises:

a tiltable frame adapted to tilt around a horizontal axis;

at least one mold comprising a shell and a cover adapted to be coupled and uncoupled, the mold obtained by coupling a cover and a shell being open at one end;

means operatively associated with the shell and cover of each mold for coupling and uncoupling the shell and cover thereof;

means securing at least one shell on the tiltable frame such that the mold is moveable with the frame between a vertical casting position for a concrete casting operation, and a horizontal unmolding position for uncoupling the shell from the cover;

means operatively associated with the mold for casting concrete into the vertically oriented mold with its open end located at its upper part, the casting of the concrete being done through the open end and resulting in providing a cast concrete element in the mold;

means operatively connected to the frame for tilting the frame to place the mold in the horizontal position with the cover being at the lower part of the mold;

means operatively connected to the coupling and uncoupling means for actuating the coupling means to separate the cover from the shell by a relative downward movement of the cover while the mold is in the horizontal position, the cast concrete element remaining in position on the cover;

a hardening zone operatively associated with the mold for hardening the concrete element;

means operatively connected to the cover for advancing the cover supporting the concrete element to the hardening zone;

means operatively connectable with a hardened concrete element in the cover for separating a hardened concrete element from the cover; and means operatively associated with the cover for reintroduction of a cover separated from the hardened concrete element into the frame to permit coupling of the cover with a shell secured to the frame for a subsequent concrete casting operation.

Preferably, the frame comprises at its lower part sealing means adapted to ensure a fluid-tight closure of the lower part of the mold in vertical position, between the shell and the cover, the abovesaid frame being moreover provided with two lateral tilting axles and including an arm engaged on a jack for actuating the tilting of the frame.

The coupling (and uncoupling) means comprise guide means borne by arms pivoted, in their middle part, on the frame, these guide means being adapted to receive and to guide axles, for example provided with rollers, projecting laterally on the covers, and rotation of the arm causes the approach or separation of the guide means from the frame. This rotation is actuated by a jack pivoted at one end on an axle secured to the frame and at the other end on a axle connected to the arms.

The means for reintroducing the covers into the frame are arranged to effect this reintroduction when the frame occupies a position inclined to the horizontal, for example inclined at 30°.

Preferably, the shells of the molds, suitably reinforced, comprise a series of housings, connected by front walls. The housings have a section corresponding to two symmetrical cross sections of a concrete element, and the covers comprise a wall provided with parallel separating partitions, each partition being designed to separate each housing of the shell into two symmetrical parts whose section corresponds to the transverse section of a concrete element, the abovesaid partitions of a cover being adapted to enter, in fluid-tight manner, openings provided in the wall of the shells.

Advantageously, for one type of element to be manufactured (for example for curbs), whose geometrical shape remains the same, but whose cross sectional dimensions may vary, the covers of the molds are of a single type and include transverse partitions whose height is provided for the maximum height of the type of element to be manufactured, and whose separation is determined by the maximum width of the type of element to be manufactured. The shells of the molds are arranged for each type of element to be manufactured, with different dimensions of the housings.

The shells are advantageously secured to the frame in dismountable manner.

When the production line is intended for the production of concrete elements such as curbs or gutters, whose shape is such that it is possible to insert in each housing of the shells a straight rod, said production line comprises an assembly of pervibrators corresponding to the number of unit molds formed by the partitions of the covers and the housings of the shells, adjusting means for the position of these pervibrators to place each pervibrator in a predetermined position with respect to a unit mold formed by a partition and a part of a housing, and means for vertical movements of the assembly of the pervibrators to insert them in the molds and extract them therefrom, so that the vibration energy can be directly transmitted to the concrete.

Advantageously, an assembly of countermolds mating the inner shape of the shells is provided. Vertical displacement means for these countermolds are provided to enable them to be lowered into the molds so that it is possible to form a space between the inner wall of the shell and the countermold in order to effect the molding of facing in this space and to place a protective sheet between said countermold and the shell.

Advantageously, the walls of the shells are filtering walls.

The production line advantageously comprises a smoothing device for the upper ends of the concrete elements, this device enabling the recovery for a subsequent operation, of the surplus concrete from a preceding operation.

The means for ensuring the hardening of the concrete elements advantageously comprise a thermally insulated tunnel in which a passage on two levels is provided, ensuring the forward and return routing of the concrete elements positioned on the covers. A transfer device is provided at one end of the passage to pass the covers provided with concrete elements from one level to the other.

The invention consists, apart from the features mentioned above, of certain other features which will be more explicitly considered below with regard to a preferred embodiment of the invention described with reference to the accompanying drawing, but which is to be considered as in no way limiting.

FIG. 1 of these drawings is a longitudinal section of a production line according to the invention taken along the line I—I (FIG. 2).

FIG. 4 is a section along the line IV—IV (FIG. 5 showing portions cut away).

FIG. 5 is a section along the line V—V (FIG. 4).

Figure 3:
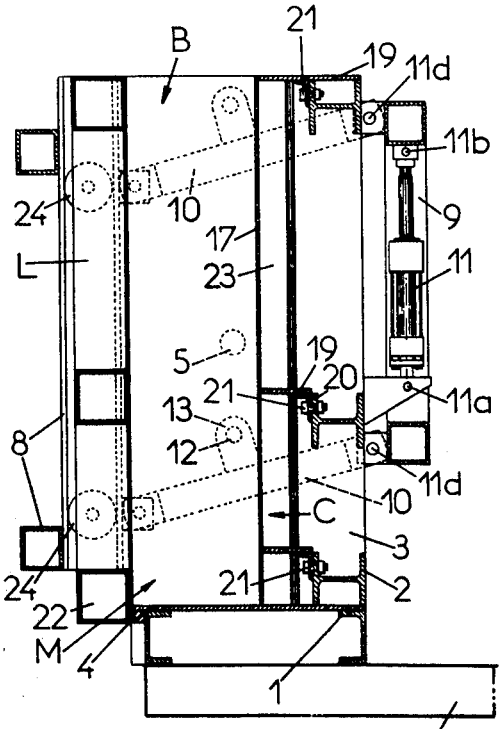
FIG. 3 is a section taken along the line III—III (FIG. 4), of a tiltable frame in the production line of FIG. 1, the frame (also shown in FIG. 9) being equipped with a coupled shell and cover forming a mold comprising several unit molds.

The production line comprises a frame B formed by a base 1, longitudinal beams 2, and two head plates 3, seen especially in FIGS. 3, 4 and 5. The position for the frame, especially of the elements 1, 2, with respect to the whole of the production line appears clearly in FIGS. 9 and 10. The frame B includes at its lower part sealing means 4 (FIGS. 3 and 4) for example constituted by a plate of elastomeric material, adapted to ensure a fluid-tight closing of a mold M (FIG. 5) formed from a shell C and a cover L adapted to be coupled or uncoupled that is to say to be united or separated. The mold M is opened at one end situated at the upper part in FIG. 3 when the mold is vertical.

The frame is adapted to tilt around a horizontal geometric axis provided in practice by two axles 5 on each side of the frame B (mounted on an outer housing as shown in FIGS. 4 and 5).

Figure 9:
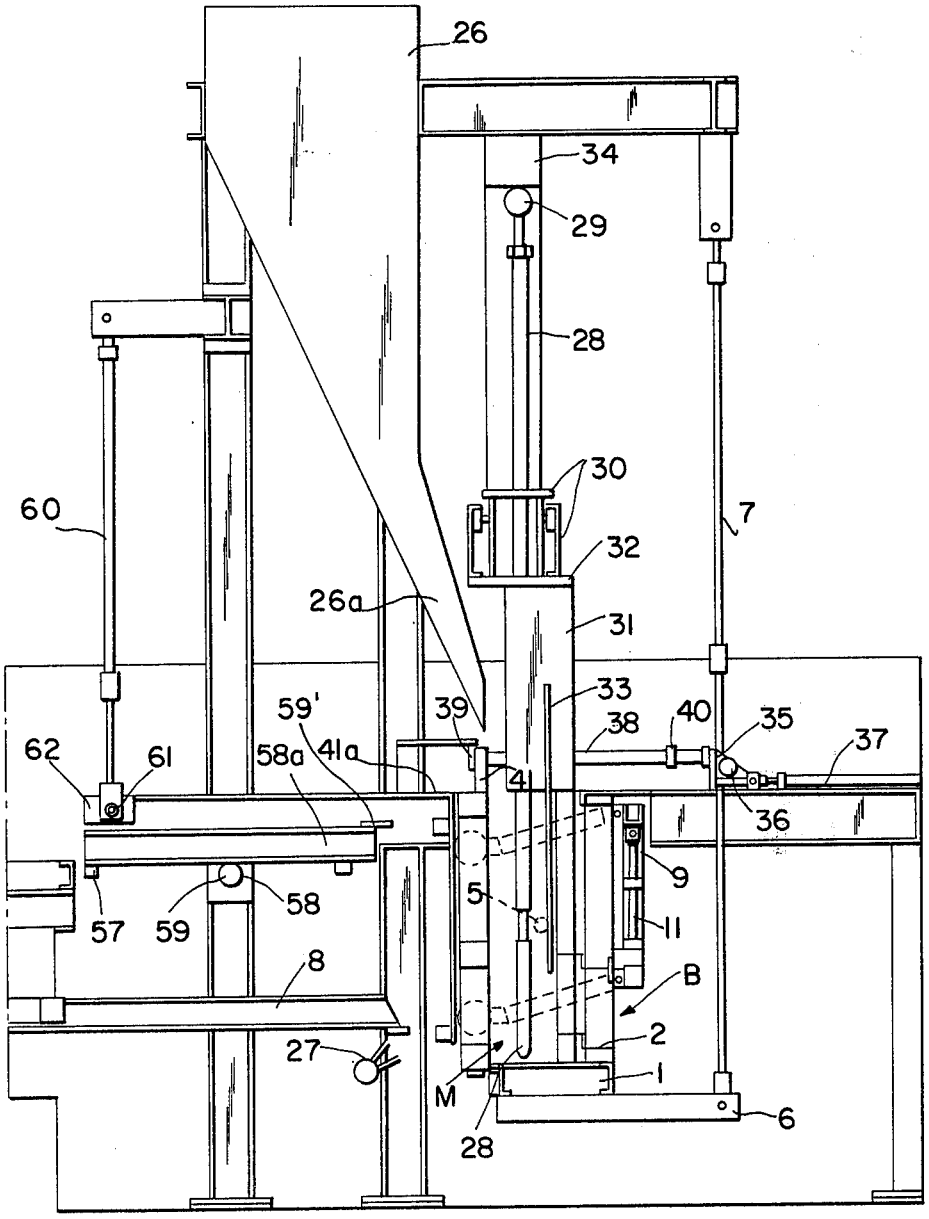
FIG. 9 is a section in elevation at a location along the line I—I (FIG. 2) of the concrete forming installation, the frame for supporting the molds being shown in vertical position.
Figure 10:
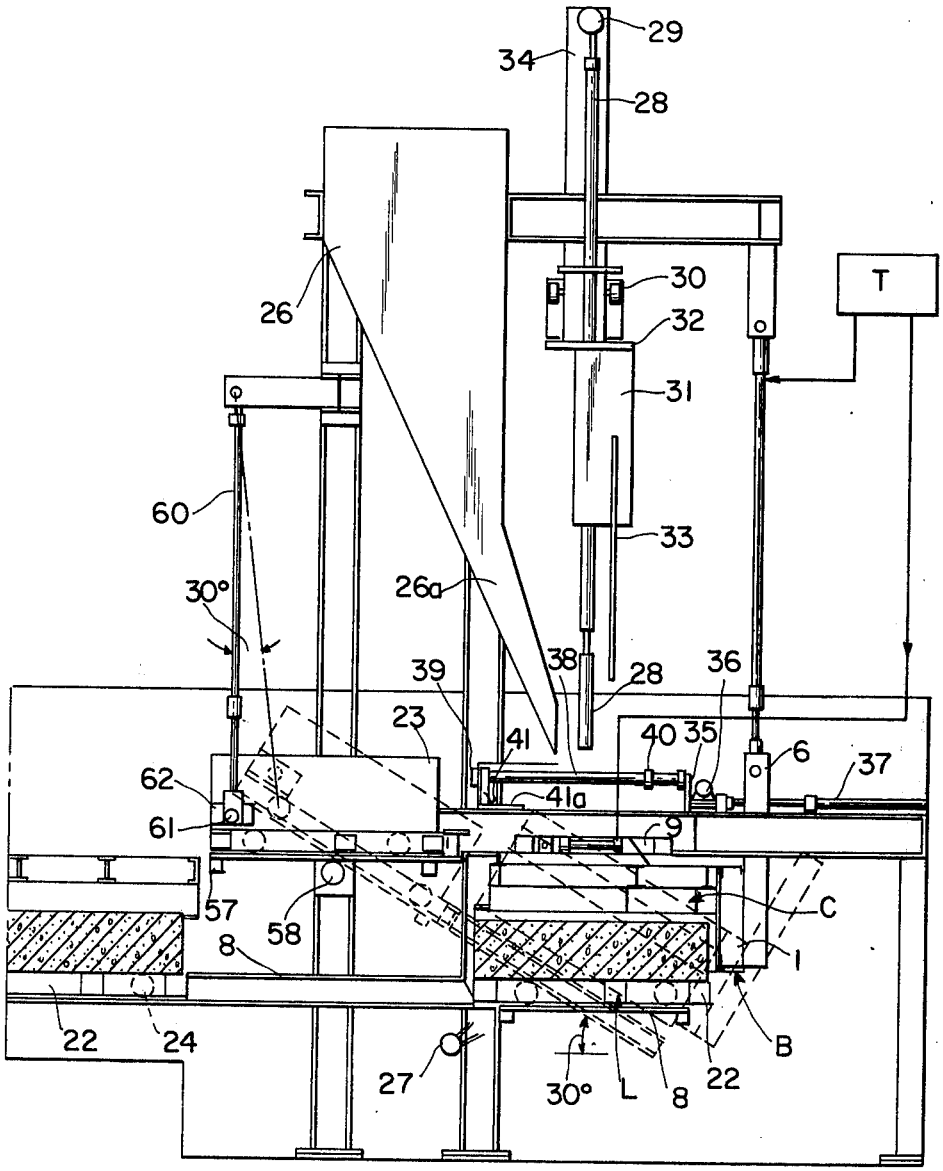
FIG. 10 is a section view like that of FIG. 9 which shows the concrete forming installation when the frame is in horizontal position, with an outline in dashes of an intermediate inclined position of the frame for the insertion of the covers.

As seen in FIGS. 9 and 10, the frame B is provided with an arm 6 connected to a jack 7. This jack is suspended from a gantry and is pivoted so as to ensure the tilting of the frame into horizontal position (FIG. 10) or into vertical position (FIG. 9) or into a position inclined at 30° (shown in dashes in FIG. 10) for the reinsertion of the covers L. The jack 7 hence forms actuating means for tilting of the frame.

The shells C are fixed in dismountable manner, on the beams 2 of the frame, for example by means of screws 21 (FIG. 4).

Coupling and uncoupling means for the shells C and the covers L are provided. These coupling and uncoupling means comprise guide means 8 (FIGS. 3 and 5) for example formed by U shaped profiled elements borne by arms 10 (FIG. 3) pivoted, at their middle part, on pivots 12 borne by the frame, through bearings 13. The guide means 8 are adapted to receive and to guide axles (FIG. 5) provided with rollers 24. These axles project laterally on both sides of the cover L. The rotation of the arms 10 around the pivot 12 (FIG. 3) causes the closing up or the separation of the guide means 8 with respect to the frame B. The rotation of the arms 10 around the pivots 12 is actuated by a double acting jack 11 (FIG. 3) pivoted at one end on an axle 11a fast to the frame B and at another end to an axle 11b fast to a frame 9 connected through the pivot 11d to the arms 10.

In the position shown in FIG. 3, the rod of the jack 11 is out and the arms 10 are turned in counterclockwise direction around the axis 12, which has caused the closing up of the guide means 8 of the frame B and the coupling of the cover L to the shell C, the rollers 24 being locked in the guide means 8. When the rod of the jack 11 enters the body of the jack, the guide means 8 separate from the frame B and the cover L is released from the shell C.

The shells C of the molds are suitably reinforced and include a series of housings E (FIG. 5) having a cross sections corresponding to symmetrical cross section *s*1, *s*2 (FIG. 5) of a concrete element. The housings E are connected by front walls 18. Each shell C may be constructed with sheet metal 17 folded along the contour of the parts to be manufactured and assembled together by means of the front walls 18. Horizontal gussets 19 and longitudinal reinforcements 20 are also provided.

Figure 6:
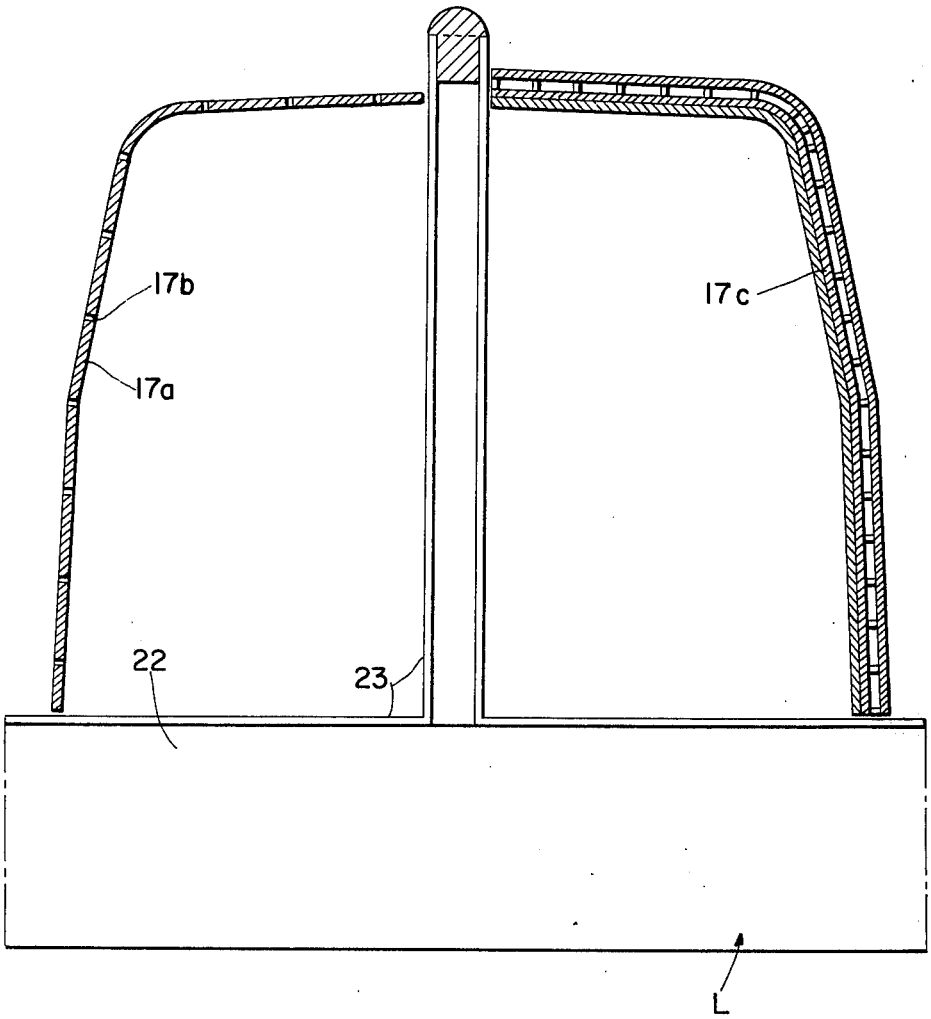
FIG. 6 is a diagrammatic cross section on a large scale of a shell coupled with a cover.

Changing of the shells is effected by lowering and by removing the shell in service with the cover L leaving the frame B and by placing a new shell on the cover L which arrives at a reinsertion station in the frame B, which will be described below. To obtain concrete elements having visible surfaces with a certain appearance, the metal sheets 17 may be replaced by sheets 17*a* (FIG. 6) with fine holes 17*b* enabling filtration of the liquid from the concrete or by absorbant or filtering walls 17*c* (FIG. 6).

Each cover L has a wall p supported by a framework 22. The wall p is provided with transverse separating partitions h (FIG. 5). Each partition h is intended to separate each housing E of the shell into two symmetrical parts whose sections correspond to the cross section of a concrete element.

The partitions h of cover L are adapted to enter in sealed manner the openings *o* (FIGS. 4 and 5) provided in the bottom of the housings E. The wall p and the partitions h may be produced from metal sheets 23 folded into a U.

The framework 22 is provided with lateral rollers 24 intended to roll in guide means 8 and guide rollers 25, advantageously four in number.

For one type of concrete element to be manufactured (for example for the edges of side walks) whose geometrical shape remains the same but whose cross section may vary between two limits (shown in FIG. 5 in dotted line), the covers L of the molds are of a single type. In this embodiment, the transverse partitions h have a height d provided for the maximum height $m_1$ of the element to be manufactured (FIG. 5).

The separation q (FIG. 5) is determined by the maximum width $n_1$ of the element to be manufactured.

The shells C of the molds are arranged, for each type of element to be manufactured, with different dimensions of the housing E.

Figure 11:
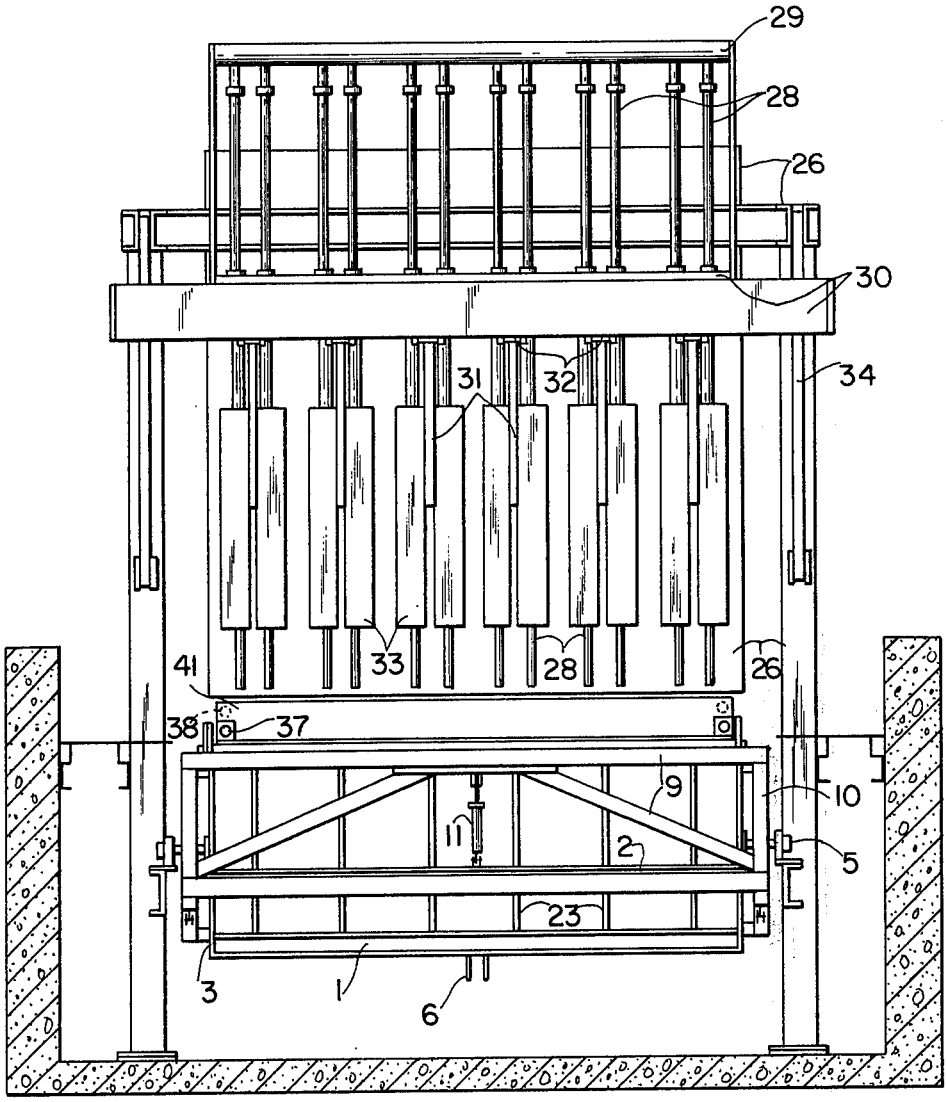
FIG. 11 is a view from the right in section along the line XI—XI (FIG. 1) of the concrete forming installation.

Means for casting of the concrete (FIGS. 9, 10 and 11) comprise a hopper 26 provided with a spout 26a enabling the concrete to be run through the upper open end of the vertically arranged molds M, as shown in FIG. 9.

The concrete casting means comprise an assembly of pervibrators 28. The number of pervibrators 28 corresponds to the number of unit molds formed by half a housing E and a partition h (FIG. 5). This unit mold enables the production of a single concrete element. The mold formed by the shell C and a cover L comprises a certain number of unit molds equal or double the number of housings E. Means 30 are provided to adjust laterally and longitudinally the position of the pervibrators 28 and to place each pervibrator in a predetermined position with respect to a unit mold. These adjusting means 30 may include a screw and rack device enabling movement of all of the pervibrators together or each pervibrator individually.

Vertical displacement means 34 of the assembly of pervibrators 28 are provided; these means 34 may comprise a motor-reducer system driving, through linking means such as a cable or a rack, the pervibrators 28 and the adjusting means 30. A rapid downward movement may be provided followed by a slow downward movement and a slow upward movement of the pervibrators 28. A compressed air distributor 29 is provided for the supply to the pervibrators 28.

A series of water jets 27 is provided to ensure washing of the frame immediately after unmolding which will be described below.

Figure 7:
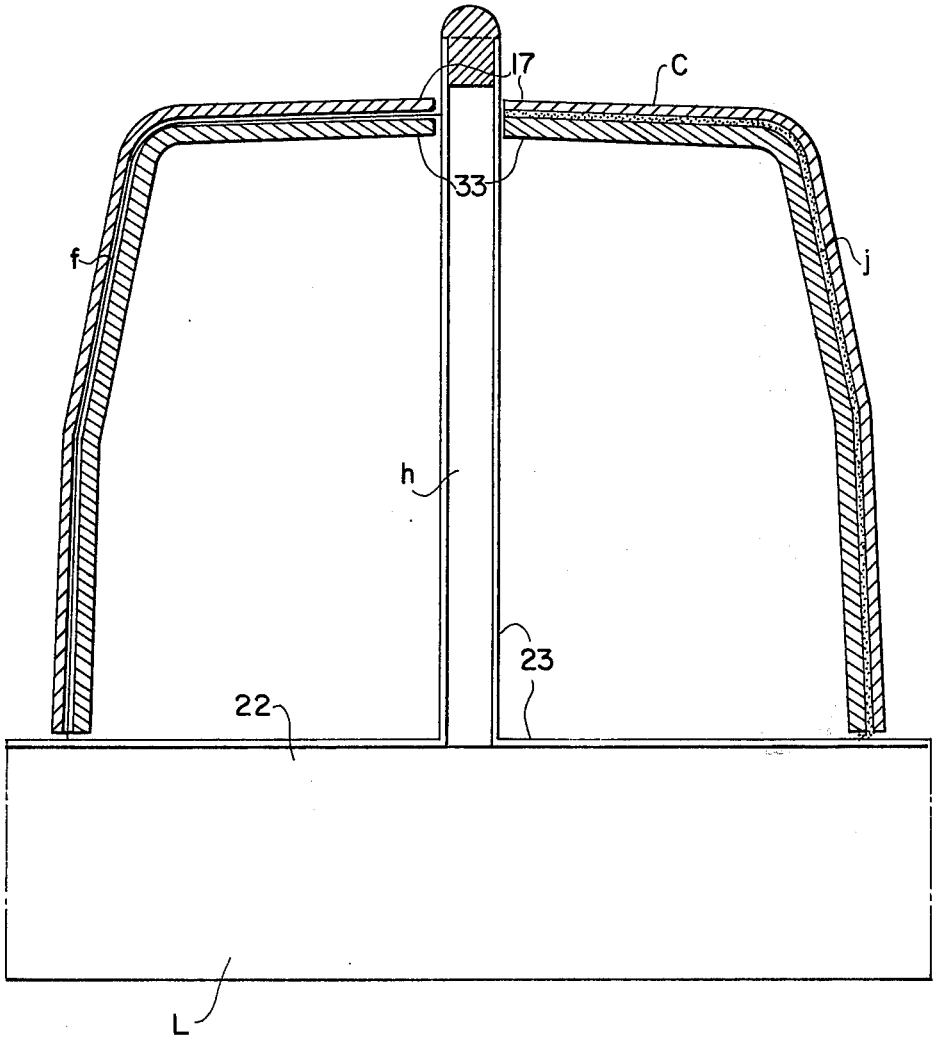
FIGS. 7 and 8 show, similarly to the FIG. 6, modifications of the mold formed by the shell and the cover.
Figure 8:
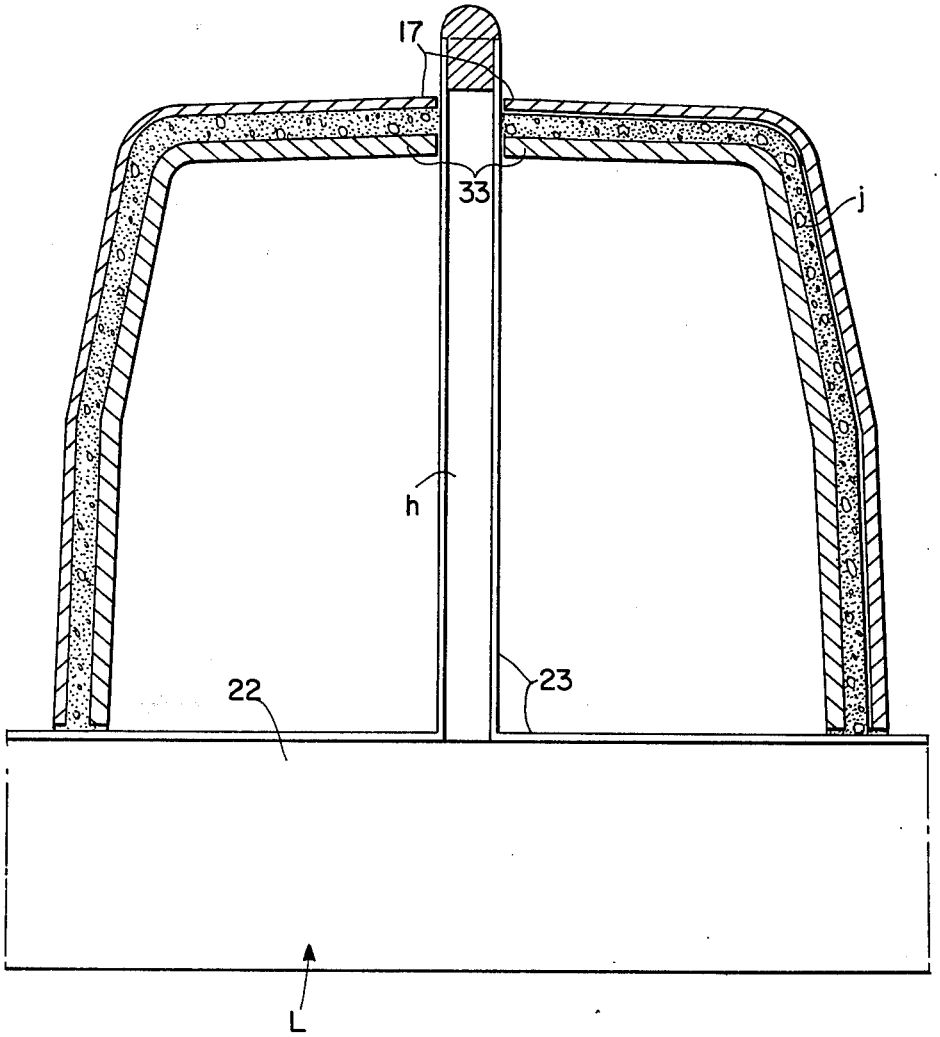

An assembly of countermolds 33 (see FIGS. 7, 8, 9, 10 and 11) is provided. These countermolds 33, as seen in FIGS. 7 and 8, mate the internal shape of the shell C so that it is possible to create a space j (FIGS. 7 and 8) between the internal wall of the shell C and the countermold 33. It is thus possible to effect the casting of a decorative facing to improve the external appearance of the concrete element, in the space j or to place between the countermold 33 and the shell C a protective sheet f of paper or of plastics material as shown in FIG. 7.

The countermolds may be adjusted laterally and longitudinally by means 32 and can be moved vertically with the assembly of pervibrators 28 and also relative to these pervibrators. Hence it appears that the pervibrators 28 and the countermolds 33 may be inserted in the single molds formed between the shell C and the cover L through the open upper end of the mold M arranged vertically. Vertical curtains 31 are provided to establish separations corresponding to the housings E, above the molds to prevent spillage. The curtains 31 are borne like the countermolds 33 by the fixing and adjusting device 32.

The installation for casting concrete also includes a smoothing device for the upper ends of the parts. This device has a longitudinal smoothing rule 35 (FIG. 10), vibrators 36, mounted on the rule, two pusher jacks 37 and two arms 38 each having two head washers 39 and two intermediate washers 40. A second rule 41 is connected in translation to the smoothing rule 35. Before casting concrete into a mold positioned vertically, the smoothing rule 35 is moved to the right of FIG. 10 and moves the rule 41. This rule 41 moves the surplus concrete after the preceding operation which is on the platform 41*a*. The surplus concrete falls into the molds before the casting operation and recovery of surplus concrete from the preceding operation is thus ensured. After the casting operation, the rule 35 advances (that is to say moves to the left of FIGS. 9 and 10) thereby vibrating the upper part of the concrete contained in the mold M and pushing the surplus concrete on to the platform 41*a* (FIG. 9).

Figure 1:
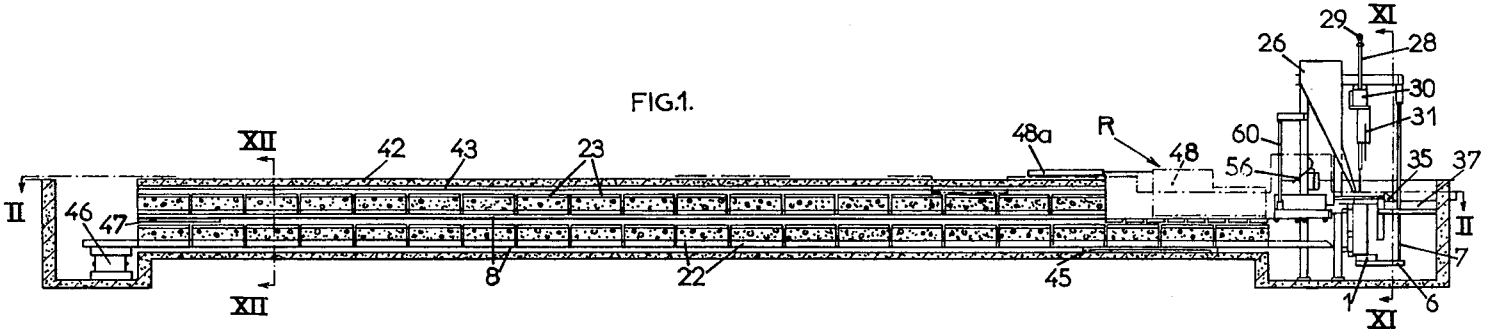
Figure 2:
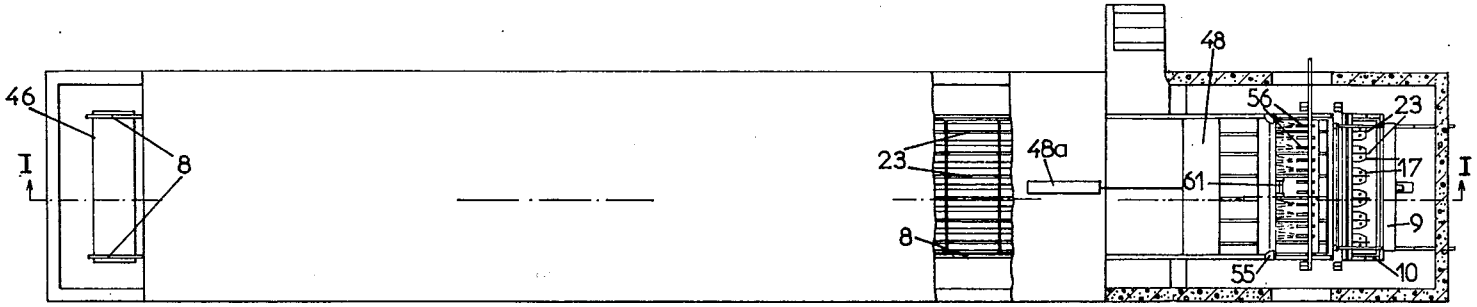
FIG. 2 is a plan view with parts in section taken along the line II—II (FIG. 1) of the production line.
Figure 12:
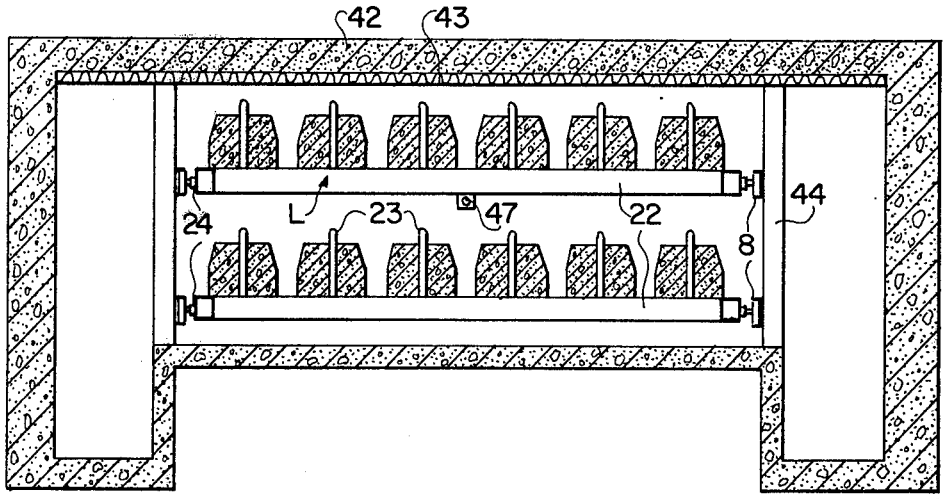
FIG. 12 is a cross section along the line XII—XII (FIG. 1) of the tunnel serving for the thermal treatment.

The means for ensuring the hardening of the concrete elements (FIGS. 1, 2, 12) include a tunnel 42 provided with thermal insulation 43, a passage on two levels ensuring the forward and return routing of the covers L, and a distribution and recovery system for the heating medium. The passage with two levels is constructed on gantries 44 connected by guides of the same type as guide means 8. Means 45 (FIG. 1 and 15) comprising a jack are provided for extracting and for pushing and advancing covers L provided with concrete elements F on the lower track.

A transfer device formed by a lifting table 46 is provided at one end of the track to transfer the covers L from the lower level to the upper level.

Another jack 47 pushes the covers on to the upper track and enables automatic routing and working rate.

Figure 13:
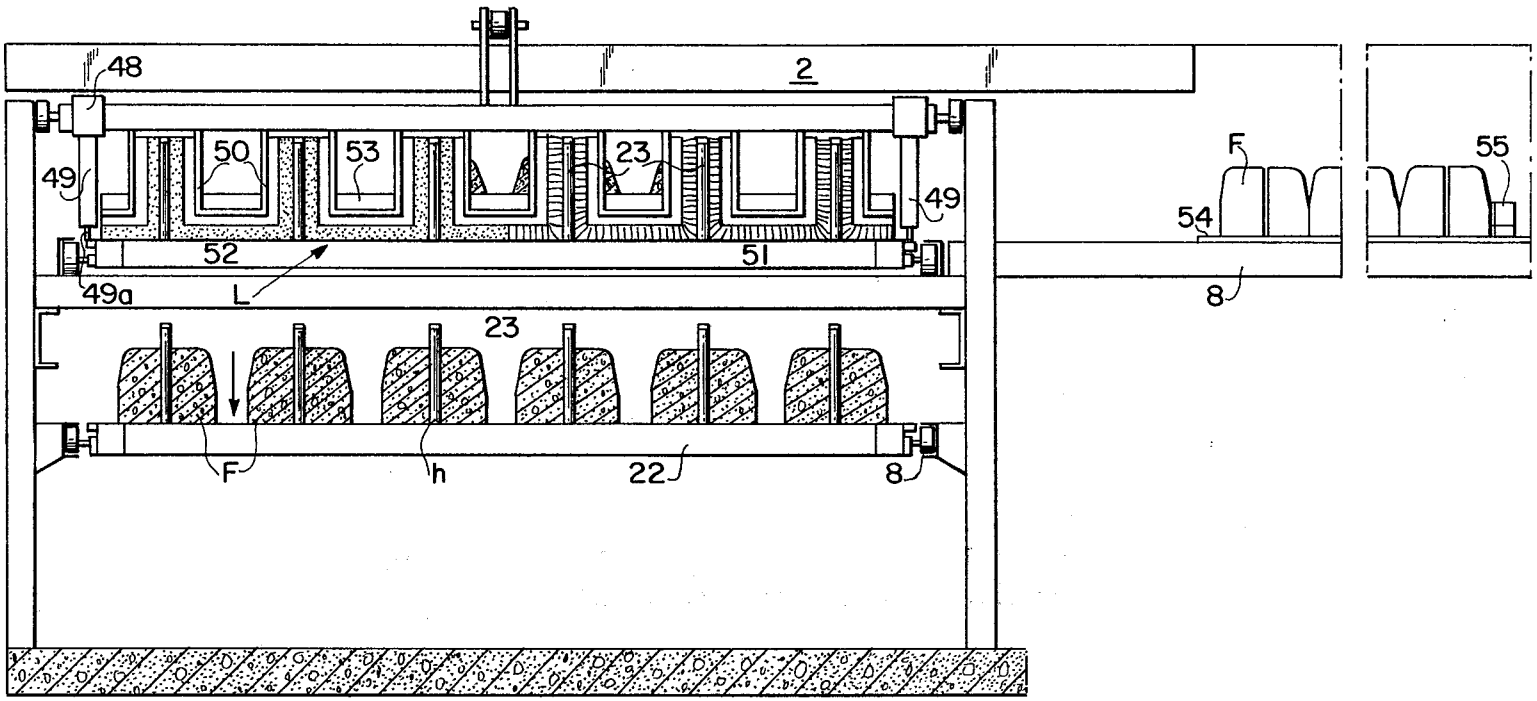
FIG. 13 is a section along the line XIII—XIII (FIG. 15) of the installation for the final unmolding and cleaning of the covers.

The installation for final unmolding and cleaning (FIGS. 13, 14, 15) of the covers L is arranged at the outlet (R) of the hardening installation.

Figure 15:
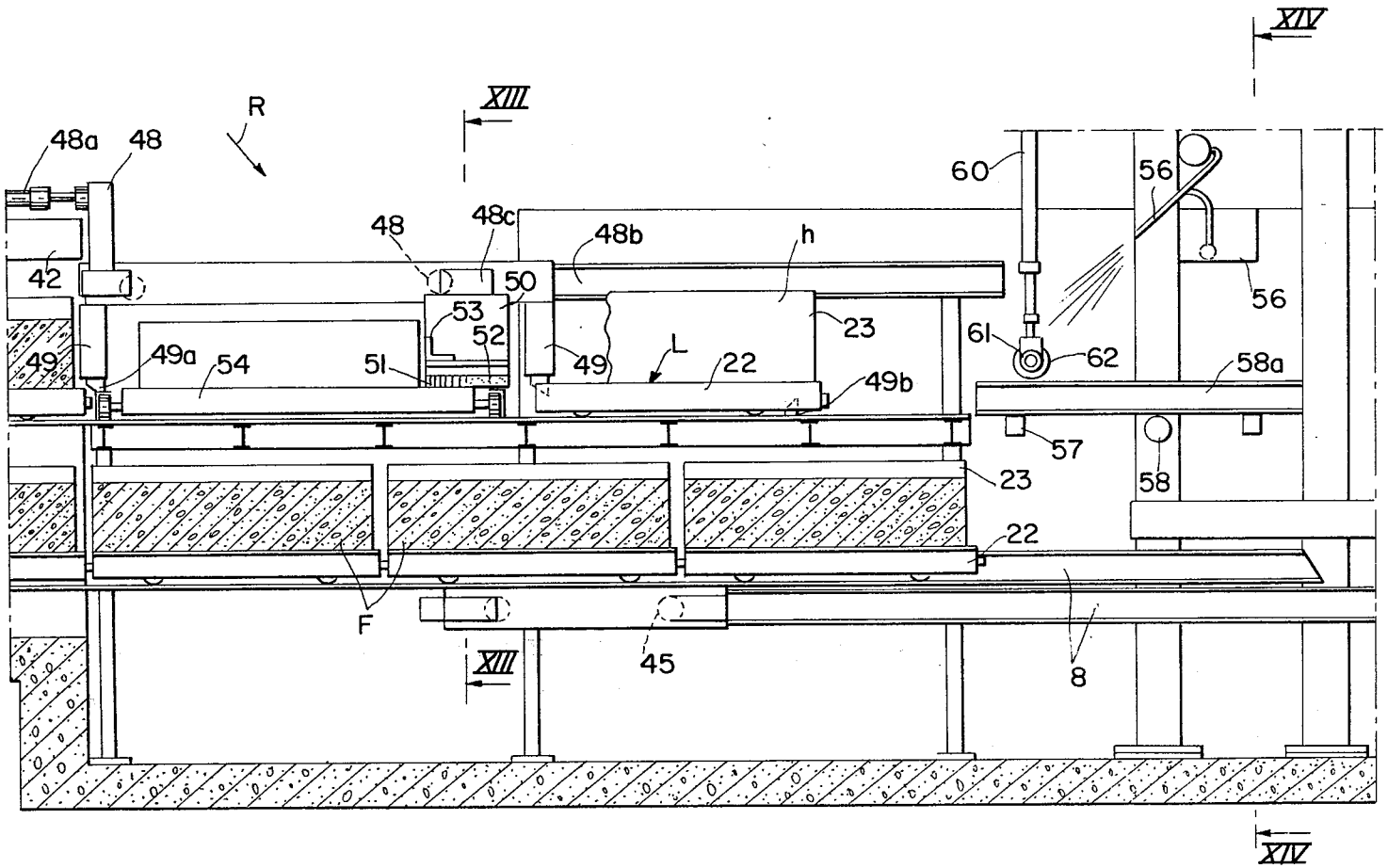
FIG. 15 is a longitudinal section of the installation for the final unmolding of the installation for the reinsertion of the covers.

This installation has a carriage 48 capable of moving parallel to the direction of advance of the covers L under the effect of a jack 48*a* (FIG. 15). The carriage is guided in its movements by rails 48*b*. This carriage 48 has vertical arms 49, preferably four in number, of which two are arranged at the front and two arranged at the rear. These arms 49 bear at their lower ends bolts 49*a* urged, by elastic means, downwardly and adapted to be withdrawn by the advance of a cover L to the right of FIG. 15, whilst carriage 48 is motionless. For a relative movement in the opposite direction of the carriage 48 and of the cover L, the bolts 49*a* are adapted to ensure a locking.

Towards the end of the carriage 48 (situated at the right of FIG. 15) is provided a transverse beam 48*c* bearing parts, 50 which are shaped as a U or L and are capable of being inserted between the partitions h of the covers L. Each part 50 has, on its outer lateral surfaces and on the outer lower surface, brushes 51 (located on the part to the left of part 50, in FIG. 15) and cloth parts 52, for example abrasive, for cleaning the inner walls of the cover L.

Each part 50 has also a push member 53 for causing final unmolding of the hardened elements. Carriage 48, in a first forward travel, takes up, the cover L by means of the two rear arms 49, which has emerged from the tunnel and causes it to advance into a position where cover L is locked by a bolt 49*b* (FIG. 15).

The final unmolding installation also has a removal carriage 54 capable of being moved transversely relative to the advancing movement of the covers. Means for actuating movements of this carriage 54 are provided to bring the carriage to the outlet of the tunnel when a cover L has just been blocked by the bolt 49b.

The carriage 48 then effects a return movement to the left of FIG. 15 and drives, by means of the pusher members 53, the hardened concrete elements and pushes them on to the removal carriage 54. Simultaneously cleaning of the covers L is ensured by the brushes 51 and the abrasive cloth 52.

The transverse movement of the carriage 54 is then actuated (FIG. 13) and a stop 55 adapted to hold the hardened elements F enables the gripping of one against the other of these elements on the carriage 54 to be ensured. Removal of the hardened elements is then provided for by suitable means.

A further advancing movement of the carriage 48 to the right of FIG. 15 is then actuated. In the course of this advancing movement, the bolts 49*a* of the front arms 49 of the carriage 48 push the cover L on to the installation 57, 58, 58*a* for reinserting the cover L into the frame B.

Figure 14:
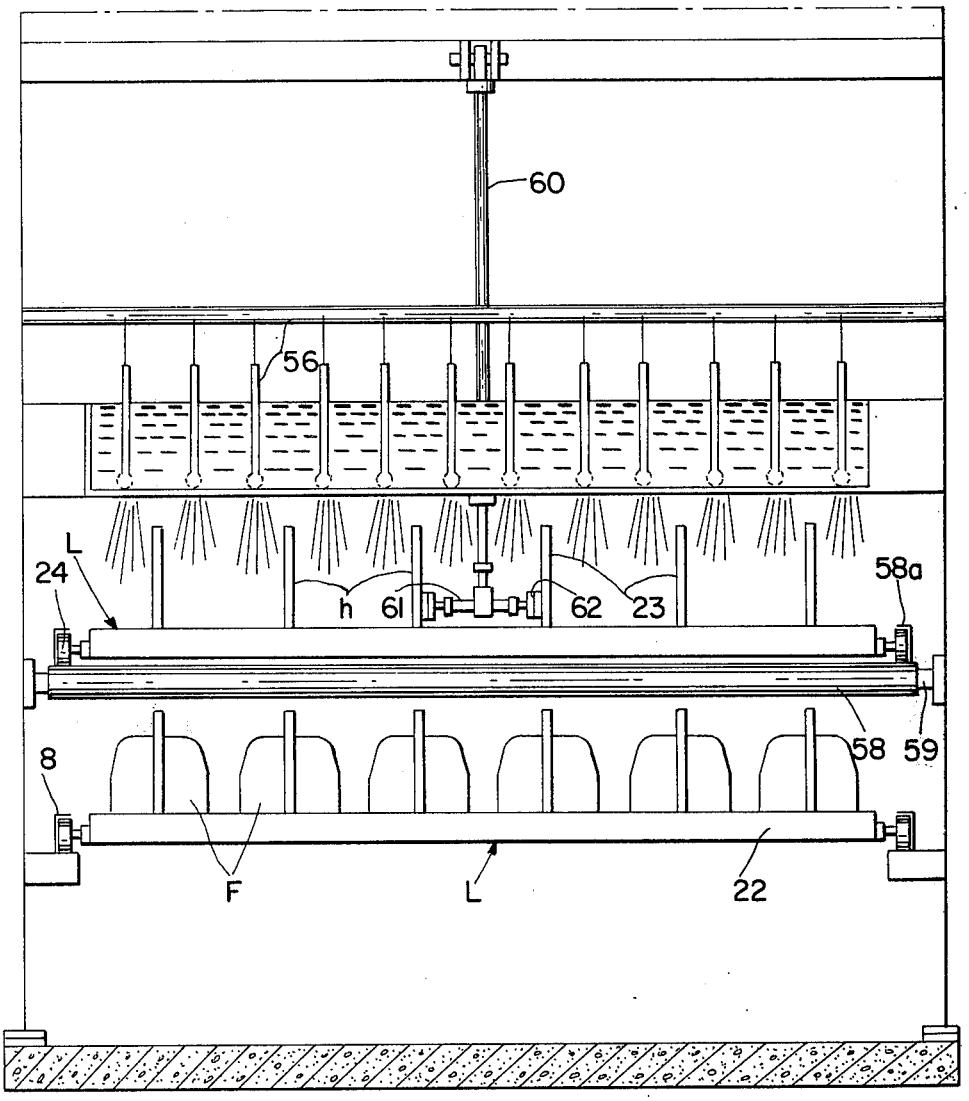
FIG. 14 is a section along the line XIV—XIV (FIG. 15) of the installation for the reinsertion of the covers in the frames, and lastly

This reinsertion installation has two lateral guides 58a, covers L, forming with the transverse beams 57 a sort of oscillating platform mounted in an offset manner on a tube 58 (being offset to the left as viewed in FIG. 15) borne rotatively at its two ends by axles 59 (FIG. 14). The offset platform is prevented from being rotated in a counterclockwise direction past the horizontal position by abutment 59' as shown in FIG. 9. The reinsertion installation also has an oscillating jack 60 suspended from a gantry and bearing at its lower end another jack 61 with a horizontal axis, oriented transversely relative to the advancing movement of the covers L. This jack 61 is a double acting jack and is adapted to be engaged between two partitions h (FIG. 14) of a cover L. The jack 61 has at its ends head plates 62 for example of elastomeric material. When this jack is supplied with fluid under pressure, the output of the one or more rods of the jack enables the two plates 62 to be applied against two opposite faces of partitions h and thus to attach the cover L to the jack 60. When this attachment of the cover L to the jack has been effected jack 60 is actuated so that tilting of the platform 57, 58*a* around axis 59 is effected, this tilting being preferably to 30° as shown in dashed line in FIG. 10, towards the right of FIG. 10. When the guide means 58*a* are in alignment with guide means 8 of the frame, jack 60 actuates introduction of the cover L into the guide means of the frame.

The reintroduction installation may be completed by a spray oiling installation 56 for the cover L (FIG. 15).

The operation of the production line is as follows. As seen in dashed lines in FIG. 10, a cover L is introduced into a frame inclined at 30° so as to be coupled with a shell C. The coupling means comprising the jack 11 (FIG. 3) is then actuated to ensure the closing of the mold M by the clamping of the cover L against the shell C.

Tilting of the frame is actuated by the jack 7 so that the mold takes a vertical position as shown in FIG. 9, with the upper end of the mold being open. The pervibrators 28 and of the countermolds 33 are then lowered into the various unit molds formed in the mold M.

If necessary, casting of a decorative facing in the space *j* between the countermold and the shell (FIGS. 7 and 8) takes place. After having recovered the surplus concrete on platform 41*a*, casting of the concrete in molds from the hopper 26 follows.

First the countermolds 33 and then the pervibrators 28 are gently raised, with more or less shifting. The vibration energy directly transmitted to the concrete and the tight gripping of the latter ensure simultaneous complete adherence of the finishing materials located in the space *j* without either straining or wearing of the molds.

This vertical method of casting with countermolds 33 enables a much better quality of finish in the parts, as well as a greater possibility of variation in dimensions. When sheets of paper or sheets of plastics material are placed between the countermolds 33 and the shells C, in the space j (FIGS. 7 and 8), the latter remain adhered to the visible surfaces of the concrete elements, thereby facilitating immediate unmolding and thereby ensuring the obtaining of concrete elements having quite smooth surfaces, by protection throughout the heat treatment. Heat treatment may then be intensified, and loss of water from the concrete is prevented by the protective sheets.

To produce parts with decorative facings there may be introduced into the space j facings previously bonded to supports. In a modification there may be cast, at the same time, the core of concrete elements inside countermolds 33 (FIGS. 7 and 8) and the outside facing of decorative concrete in the space j. In that event, external vibrators are provided, outside the shells, to vibrate the concrete occuring in the space *j*.

When the operation of casting the concrete in the mold is terminated, mold M is tilted into the horizontal position shown in FIG. 10 in full lines.

The uncoupling-coupling means (jack 11, FIG. 3) is then actuated to cause relative lowering and advancing movement of the cover L with respect to the shell C.

This operation consists of an immediate unmolding operation in the course of which the fresh concrete elements are separated from the shell C but remain on the horizontal cover L. The cover L supporting the fresh concrete elements is then introduced into the hardening tunnel 42 and traverses this tunnel.

At the outlet of the tunnel R (FIG. 1) the covers L pass into a final unmolding installation which separates the hardened concrete elements from the covers. The elements of hardened concrete are removed laterally with respect to the production line and the covers L are reinserted by the reinsertion installation in frame B and again coupled with a shell C for another molding operation.

The reintroduction of the covers L into the frame is effected in an inclined position, for example at 30° as shown in FIG. 10, of the frame.

All the installations described are connected to a control panel T (FIG. 10) which ensures the operation, particularly the automatic operation, of the production line.

Control panel T comprises, especially, control means of the jack 7 for tilting the frame and of the jack 11 for coupling and uncoupling shells and covers. The control means may comprise directional control valves, manually or automatically actuated, for feeding to or evacuating from the jacks 7 and 11 a fluid under pressure.

I claim:

1. Apparatus for the production of concrete elements comprising in combination:

a tiltable frame adapted to tilt around a horizontal axis;

at least one mold comprising a shell and a cover adapted to be coupled and uncoupled, the mold obtained by coupling a cover and a shell being open at one end;

means operatively associated with said shell and cover of each mold for coupling and uncoupling the shell and cover thereof;

means securing at least one shell on said tiltable frame such that said mold is moveable with said frame between a vertical casting position for a concrete casting operation, and a horizontal unmolding position for uncoupling said shell from said cover;

means operatively associated with said mold for casting concrete into the vertically oriented mold with its open end located at its upper part, the casting of the concrete being done through said open end and resulting in providing a cast concrete element in said mold;

means operatively connected to the frame for tilting the frame to place the mold in said horizontal position with said cover being at the lower part of the mold;

means operatively connected to said coupling and uncoupling means for actuating the coupling means to separate the cover from the shell by a relative downward movement of said cover while the mold is in said horizontal position, the cast concrete element remaining in position on said cover;

a hardening zone operatively associated with said mold for hardening the concrete element;

means operatively connected to said cover for advancing said cover supporting said concrete element to said hardening zone;

means operatively associated with said cover for separating a hardened concrete element from said cover; and means operatively associated with said cover for reintroduction of a cover separated from said hardened concrete element into said frame to permit coupling of said cover with a shell secured to said frame for a subsequent concrete casting operation.

2. Apparatus according to claim 1 in which said frame comprises at its lower part, sealing means operatively associated with said shell and cover adapted to ensure fluid-tight closing of the lower part of the mold between the shell and the cover, said frame being also provided with two lateral axles about which said frame tilts, said frame tilting means comprising a hydraulically actuated arm connected to said frame.

3. Apparatus according to claim 1, in which the coupling and uncoupling means comprise guide means adapted to receive axles projecting laterally on said cover, said guide means being carried by arms hinged at their middle part to the frame, rotation of the arms causing the approach or separation of the guide means with respect to the frame, said rotation being actuated by a hydraulically actuated member pivoted at one end on an axle fast to the frame and at the other end on an axle connected to said arms.

4. Apparatus according to claim 1 in which said shell comprises a housing having sections corresponding to two symmetrical cross sections of a concrete element, and said cover comprises a wall provided with parallel separating partitions, each partition, on coupling said shell and cover, separating each housing section into two symmetrical parts each of which has a cross section corresponding to the cross section of a concrete element, said partitions, on coupling said shell and cover, entering, in a sealed manner, openings provided in the housing of the shells.

5. Apparatus according to claim 4 in which said partitions have a height provided for the maximum height of the type of element to be manufactured, and a spacing determined by the maximum width of the type of elements to be manufactured, said apparatus including a plurality of shells of different size for each type of element to be manufactured with different housing section dimensions adapted to be coupled and uncoupled with said cover.

6. Apparatus according to claim 4 comprising an assembly of vibrators operatively associated with said mold the number of which corresponds to the number of mold cavities formed by the partitions of the cover and the housing sections of the shell, and means operatively connected to said vibrators for removeably positioning said vibrators in said mold to vibrate concrete therein.

7. Apparatus according to claim 6, comprising an assembly of countermolds operatively associated with said mold mating the inner shape of said mold cavities, and vertical displacement means operatively connected to said countermolds for lowering the countermolds into the mold cavities to form a space between the inner wall of the mold cavities and the countermold.

8. Apparatus according to claim 4, in which the walls of the shell are perforated.

9. Apparatus according to claim 1, comprising a concrete smoothing means which is in cooperation with the upper part of said mold, where said smoothing means comprises a hydraulically actuated longitudinal smoothing member provided with a vibrator, and a plate operatively associated with the mold for the recovery of the excess concrete removed from the upper end of a cast element, and means operatively associated with the mold for introducing into a mold, at the beginning of a molding operation, any excess concrete on said plate from the preceding operation.

10. Apparatus according to claim 1, wherein said concrete hardening zone comprises a thermally insulated tunnel in which a passage is provided on two levels, a transfer device provided at one end of the passage to cause covers provided with the concrete elements to pass from one level to the other, and means operatively associated with the tunnel for moving said covers provided with said concrete elements through said tunnel along said passage.

11. Apparatus according to claim 4, further including means operatively associated with said cover for cleaning the concrete contacting surfaces of a cover separated from a hardened concrete element.

12. Apparatus according to claim 7, in which the means for the reintroduction of the cover comprise lateral guiding means for the cover, said guiding means forming with transverse beams a table supported by a pivotably mounted tube, an oscillating suspended jack bearing at its lower end a further jack having a horizontal axis, transversely oriented with respect to the line of advance of the covers, said further jack being adapted to pass between two partitions of a cover and having two end plates adapted to come into engagement with said partitions for securing the cover to the oscillating suspended jack.

13. Apparatus according to claim 3, wherein said axles are provided with rollers.

14. Apparatus according to claim 4, in which said means for separating a hardened concrete element from said cover comprises a first carriage operatively associated with the cover movable along a direction parallel to the advancing covers, said carriage being provided with bearing arms having bolts for grasping a cover only when the carriage moves forward, said carriage having members arranged for insertion between the partitions of a cover, each member having outer lateral surfaces and an outer lower surface provided with cleaning means, and further having a push member for separating a hardened concrete element from said cover, actuating means operatively connected to the first carriage for moving the first carriage alternatively forwardly and backwardly, the backward movement of the carriage causing in cooperation with said push member the unmolding of the concrete elements and the cleaning of the cover and a second carriage operatively associated with the first carriage movable transversely with respect to the covers for removing the unmolded concrete elements.

15. Apparatus according to claim 1, in which the means for tilting said frame comprising an arm and jack assembly which is connected to an independent gantry.

* * * * *